United States Patent [19]

Hashimoto

[11] Patent Number: 5,011,379

[45] Date of Patent: Apr. 30, 1991

[54] ELECTROMAGNETIC DIAPHRAGM PUMP

[75] Inventor: Atsuki Hashimoto, Tokyo, Japan

[73] Assignee: Nitto Kohki Co., Ltd., Tokyo, Japan

[21] Appl. No.: 441,277

[22] Filed: Nov. 27, 1989

[30] Foreign Application Priority Data

Dec. 15, 1988 [JP] Japan ..... 63-161890[U]

[51] Int. Cl.[5] ..... F04B 45/04; F04B 39/14

[52] U.S. Cl. ..... 417/360; 417/413; 417/418

[58] Field of Search ..... 417/360, 413, 418, 417

[56] References Cited

U.S. PATENT DOCUMENTS

| | | | |
|---|---|---|---|
| 2,788,170 | 4/1957 | Kato et al. | 417/413 |
| 3,515,966 | 6/1970 | De Valroger et al. | 417/413 X |
| 3,825,374 | 7/1974 | Kondo | 417/413 |
| 3,830,596 | 8/1974 | Kondo | 417/413 |
| 4,406,591 | 9/1983 | Louis | 417/413 X |
| 4,608,000 | 8/1986 | Tominaga | 417/413 |
| 4,859,152 | 8/1989 | Kimura | 417/360 X |
| 4,931,000 | 6/1990 | Fleming, Jr. | 417/413 X |

FOREIGN PATENT DOCUMENTS

| | | | |
|---|---|---|---|
| 54-113506 | 9/1979 | Japan | 417/413 |
| 55-153877 | 12/1980 | Japan | 417/413 |
| 61-137892 | 8/1986 | Japan . | |
| 61-252881 | 11/1986 | Japan . | |
| 63-100682 | 6/1988 | Japan . | |
| 63-112285 | 7/1988 | Japan . | |

*Primary Examiner*—Leonard E. Smith
*Assistant Examiner*—Eugene L. Szczecina, Jr.
*Attorney, Agent, or Firm*—Kinney & Lange

[57] ABSTRACT

An electromagnetic diaphragm pump, the mounts for positioning and mounting the field cores on the housing and the fitting portions for fitting the peripheral portions of the diaphragms are integrally formed with the housing so that the attaching positions of the field cores never shift after they are attached. Screw holes are formed through the mounts for attaching the field cores to make the attaching and fixing of the field cores easier.

5 Claims, 11 Drawing Sheets

ELECTROMAGNETIC DIAPHRAGM PUMP

BACKGROUND OF THE INVENTION

1. Field of the Invention

This invention relates to an electromagnetic diaphragm pump, and particularly to an electromagnetic diaphragm pump which can easily be assembled and improve the pump efficiency.

2. Description of the Prior Art

A conventional electromagnetic diaphragm pump is described by using the drawings. FIG. 14 is a cross-sectional view of the conventional electromagnetic diaphragm pump, FIG. 15 is a plan view of the diaphragm pump of FIG. 14, and FIG. 16 is a side view along the X—X line of FIG. 15.

In these figures, a housing 1 is made by the press operation of a metal plate, and each of side plates 1A is punched with a circular hole 1B, the side plates being bent at both ends thereof so as to oppose each other.

A pair of diaphragm plates 2 are fitted into the circular holes 1B, respectively. The expanded peripheral portion of each diaphragm 4 made of an elastic material such as rubber is pinched by and between corresponding the diaphragm plate 2 and a head cover 3. Each symbol 100D represents the fitting portion or recess which is formed in the diaphragm plate 2 and receives the expanded peripheral portions of the diaphragms 4. The diaphragm plate 2, the head cover 3 and diaphragm 4 are attached to the side plate 1A of the housing 1 using screws 18.

A pair of plate-like magnets 8 are held in a plate-like magnet holder 6 which is a part of an electromagnetic diaphragm pump and preferably formed of a material such as aluminium. The pair of diaphragms 4 are attached to both ends of the magnet holder 6 by using pressing tools 5 and screws 7. The magnet holder 6 and magnets 8 constitute a vibrator of the electromagnetic diaphragm pump.

Inside each head cover 3, a diaphragm chamber 3A is formed. On each diaphragm chamber 3A, there are formed an intake port 14A and a discharge port 15A, which are provided with an intake valve 14 and a discharge valve 15, respectively.

Each field core 9 is an iron core of laminated silicon steel pates in the shape of "E", and, as shown in FIG. 15, the central leg thereof is fitted in a coil 11 wound around a bobbin 10.

The electromagnetic diaphragm pump is provided with two such field cores 9, which are fixed to the bottom of the housing 1 using bolts 12 and nuts 13 so as to sandwich the magnet holder 6. Since it is needed to support the field cores 9 apart from the bottom of the housing 1 by a predetermined distance, a sleeve 16 is passed through with the bolt 12 as shown in FIG. 16.

Such electromagnetic diaphragm pump is attached through, for instance, rubber vibration insulators 19, to a fluid tank 20 as seen in FIG. 14. A pressurized fluid such as air is discharged into the tank 20 as shown by an arrow C via a tube 17 connected to the head cover 3.

FIG. 17 is a schematic plan view for showing the operation principle of the electromagnetic diaphragm pump. In FIG. 17, the symbols same as those in FIG. 14 or FIG. 16 indicate the same or identical portions.

A pair of magnets 8 attached to the magnet holder 6 are arranged, as shown, so that the magnetic poles of the pair of magnets 8 are reverse to each other. Accordingly, if the coil is supplied with an a.c. current so that a magnetic flux passes from one field core 9 to the other field core 9 in the direction of a solid arrow P or a dotted arrow Q, the magnet holder 6 is reciprocated in the direction of an arrow R by the attractive and repulsive actions between the magnets 8 and a magnetic flux P or Q, whereby the diaphragm 4 is vibrated.

As a result, as shown in FIG. 15 by an arrow A, a fluid is sucked into the diaphragm chamber 3A through the side plate 1A of the housing 1, an opening 1D formed in the diaphragm plate 2 and head cover 3, the intake port 14A and intake valve 14, and the fluid passes through the discharge port 15A and discharge valve 15 as shown by the arrow B and then the fluid is discharged from the tube 17 into the fluid tank 20 as shown by the arrow C in FIG. 14.

Such electromagnetic diaphragm pump is described in, for instance, the Japanese Patent Laid-open Publication No. Showa 61-252881 and the Utility Model Laid-open Publication Nos. Showa 63-100682, 63-112285 and 61-137892.

The above described prior art had the following problems.

(1) As previously described, the field cores 9 are attached to the housing using bolts 12 and nuts 13. Here, the holes for insertion of the bolts 12 formed in the bottom of the housing 1 and the field cores 9 have a diameter that is little larger than the outer diameter of the bolts. Accordingly, a jig is required to accurately position and attach the field cores 9 to the housing, so the attaching work is cumbersome.

Also, even if the positioning was performed accurately enough, after the assembling of the electromagnetic diaphragm pump, the attaching positions of the field cores 9 can shift when the pump is transported, or when it is operated. If the attaching position of the field cores 9 shifts, the field cores 9 may move away from the vibrator to decrease the efficiency of the electromagnetic diaphragm pump, or the field cores 9 may move toward the vibrator to lose the balance of the vibration and reduce the durability of the diaphragms.

(2) The housing is made by a press work of a metal plate, and as a result, the dimensional accuracy of the various portions of the housing is difficult to increase. For instance, it is very difficult to accurately establish the distance between the pair of side plates 1A in each of which the attaching hole or the circular hole 1B is formed for fitting the diaphragm plate 2 of the diaphragms 4.

Therefore, it is difficult to accurately set the distance between the pair of diaphragms 4, which in turn will make it difficult to improve the efficiency of the electromagnetic diaphragm pump to the greatest extent.

SUMMARY OF THE INVENTION

It is the object of this invention to provide an electromagnetic diaphragm pump which can easily be assembled and improve the pump efficiency.

In order to accomplish the above-mentioned object, this invention is characterized in that the mounts for positioning and mounting the field cores on the housing and the fitting portions for fitting the peripheral portions of the diaphragms are integrally formed with the housing. With this, the field cores can be accurately positioned only by mounting them on the mounts.

Also, this invention is characterized in that stepwise portions are formed on the top of the mounts. In this construction, since the field cores are positioned by abutting on the stepwise portions, the attaching positions of the field cores never shift after they are attached. In addition, it is easy to increase the dimensional accuracy of the housing, mounts and fitting portions.

Further, this invention is also characterized in that screw holes are formed through the mounts for attaching the field cores. This makes the attaching and fixing of the field cores easier. Also, the characteristic feature of this invention resides in that the mounts, fitting portions and housing are integrally molded with a resin. With this, the leakage magnetic fluxes which are generated from the field cores and pass through within the housing are decreased.

DETAILED DESCRIPTION OF THE INVENTION

Figure 1:
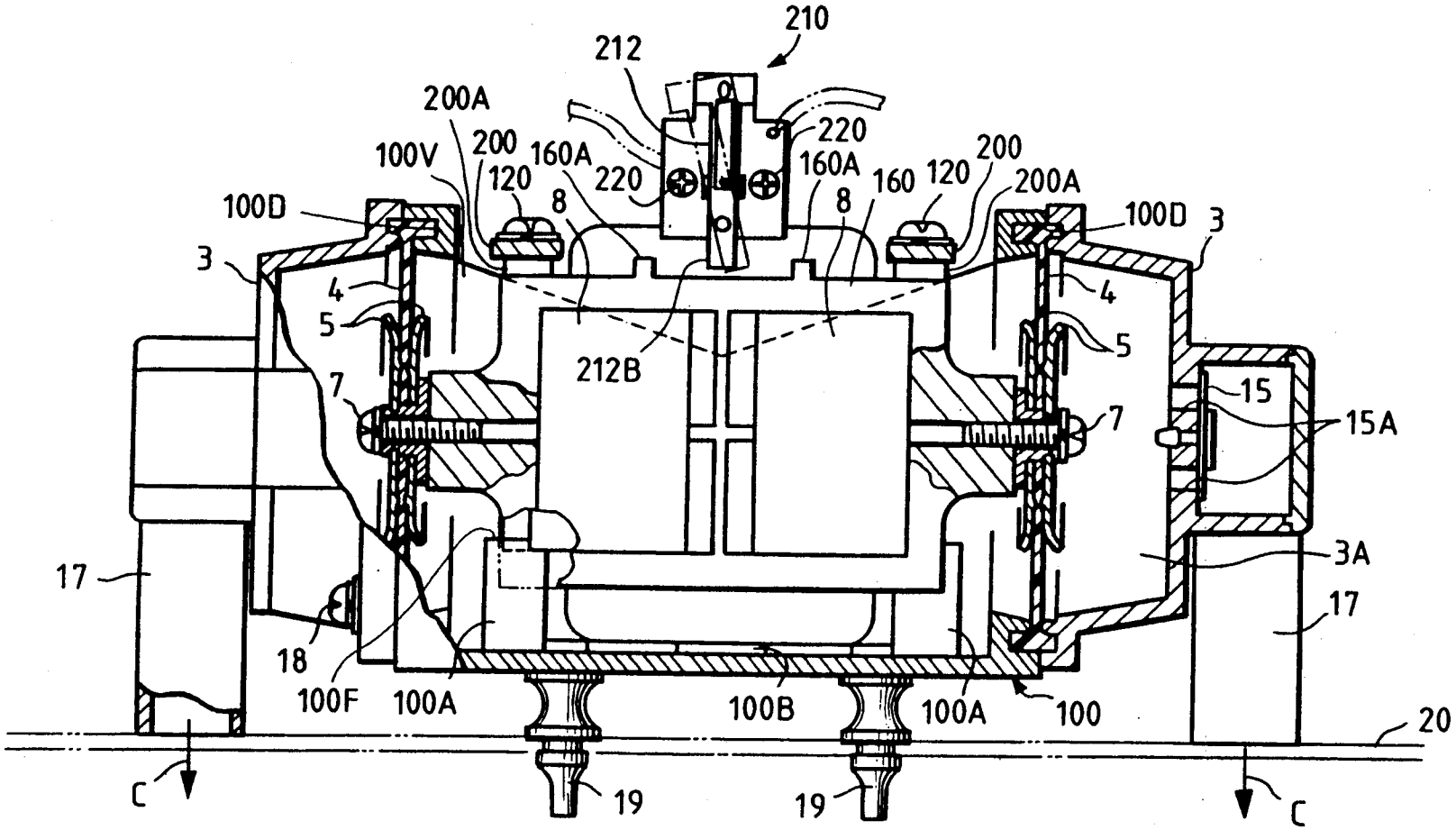
FIG. 1 is a partially cross-sectional front view of an embodiment of this invention.
Figure 2:
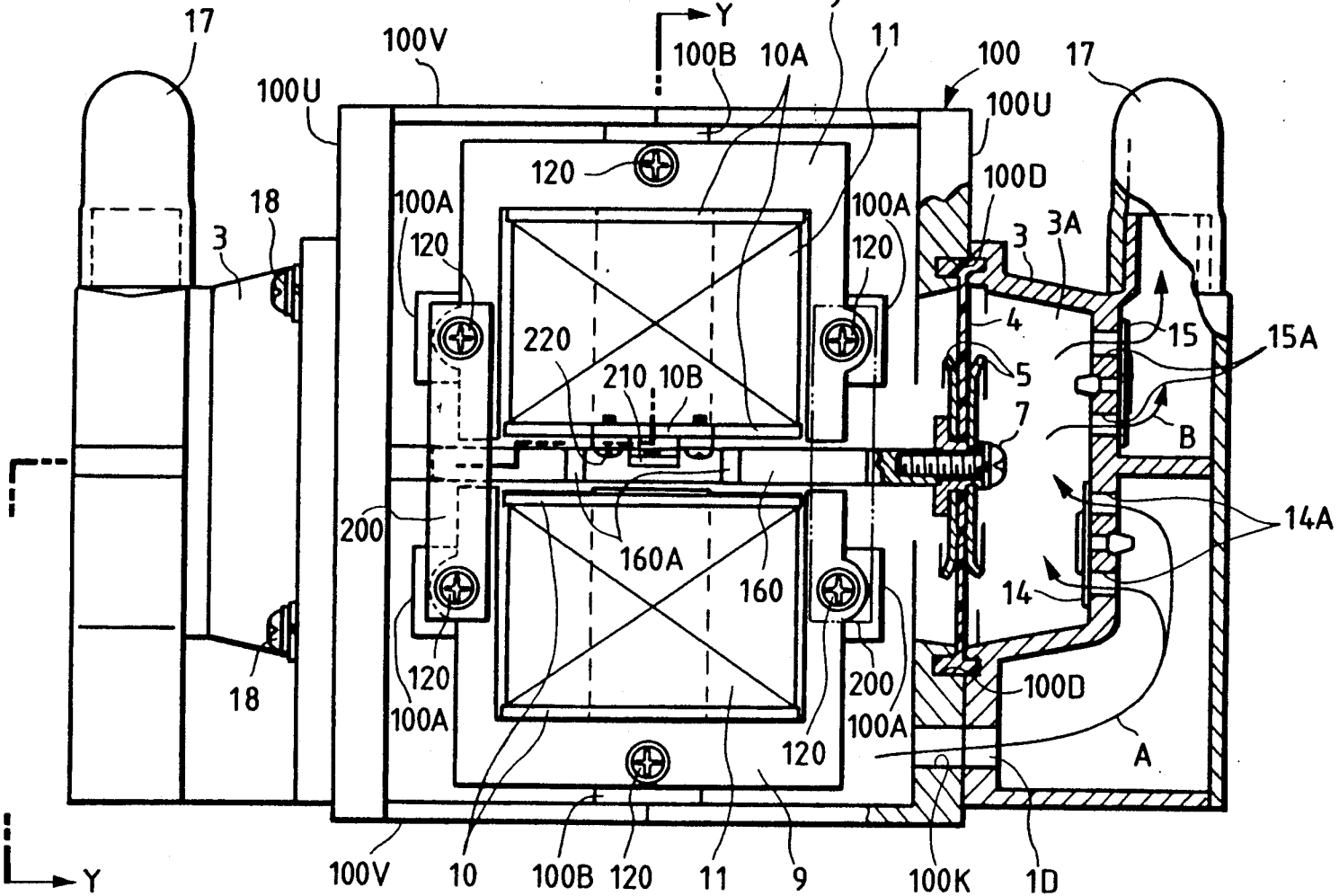
FIG. 2 is a partially cross-sectional plan view of the embodiment of this invention.
Figure 3:
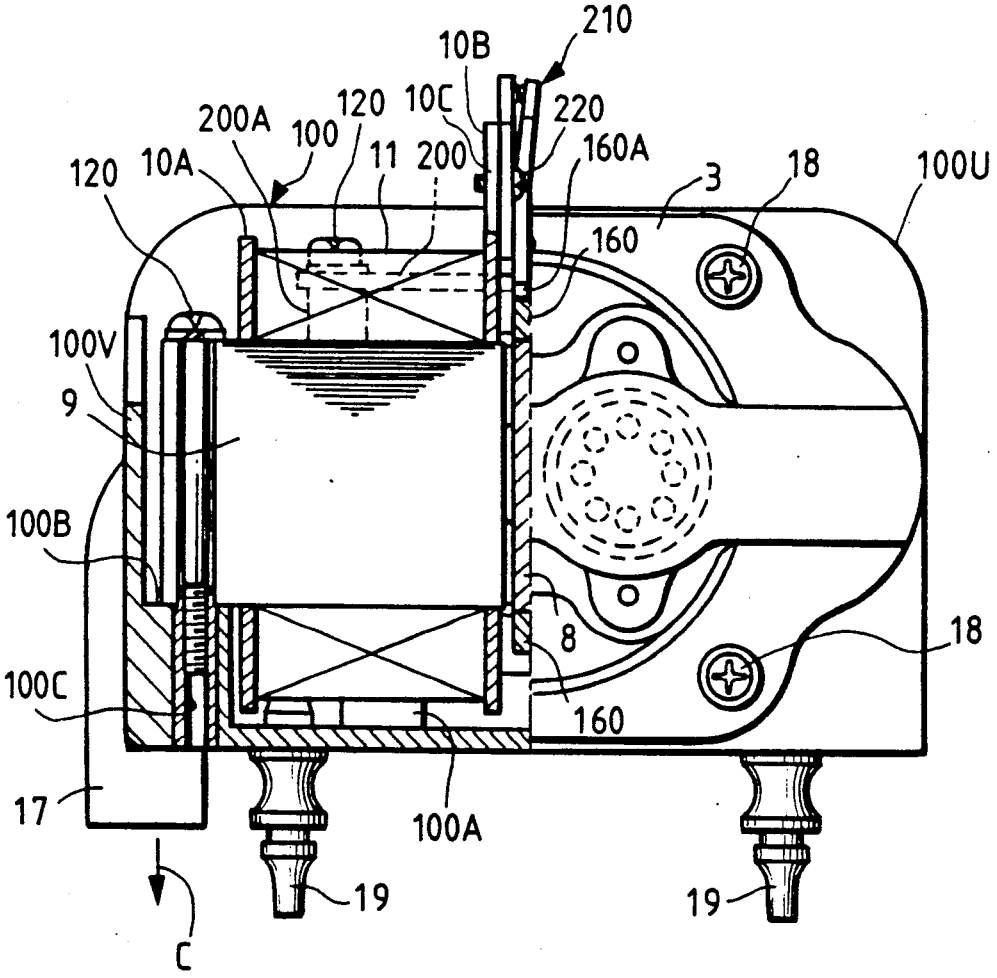
FIG. 3 is a cross-sectional view along the Y—Y line of FIG. 2.
Figure 14:
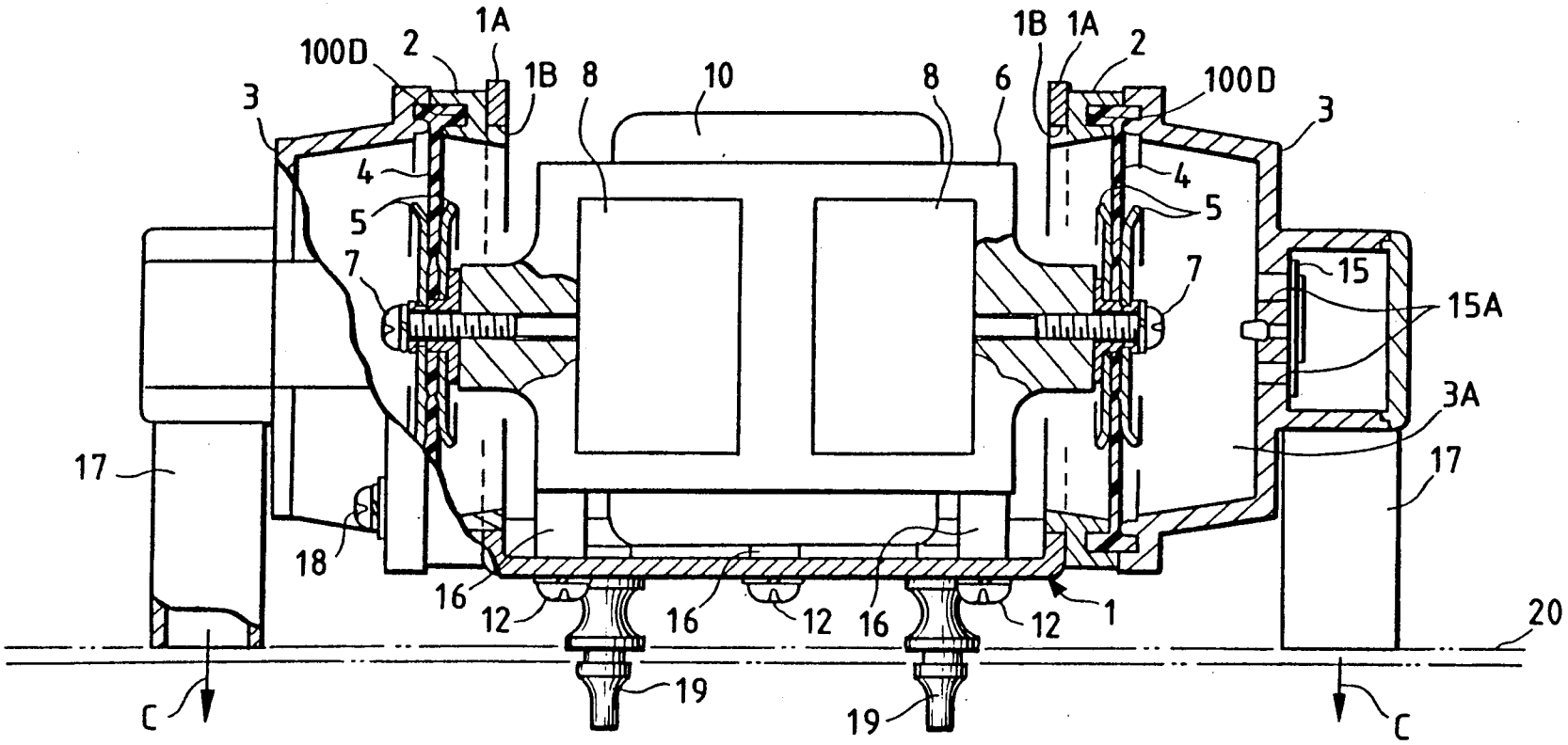
FIG. 14 PRIOR ART
FIG. 14 is a partially cross-sectional front view of the prior art electromagnetic diaphragm pump.
Figure 15:
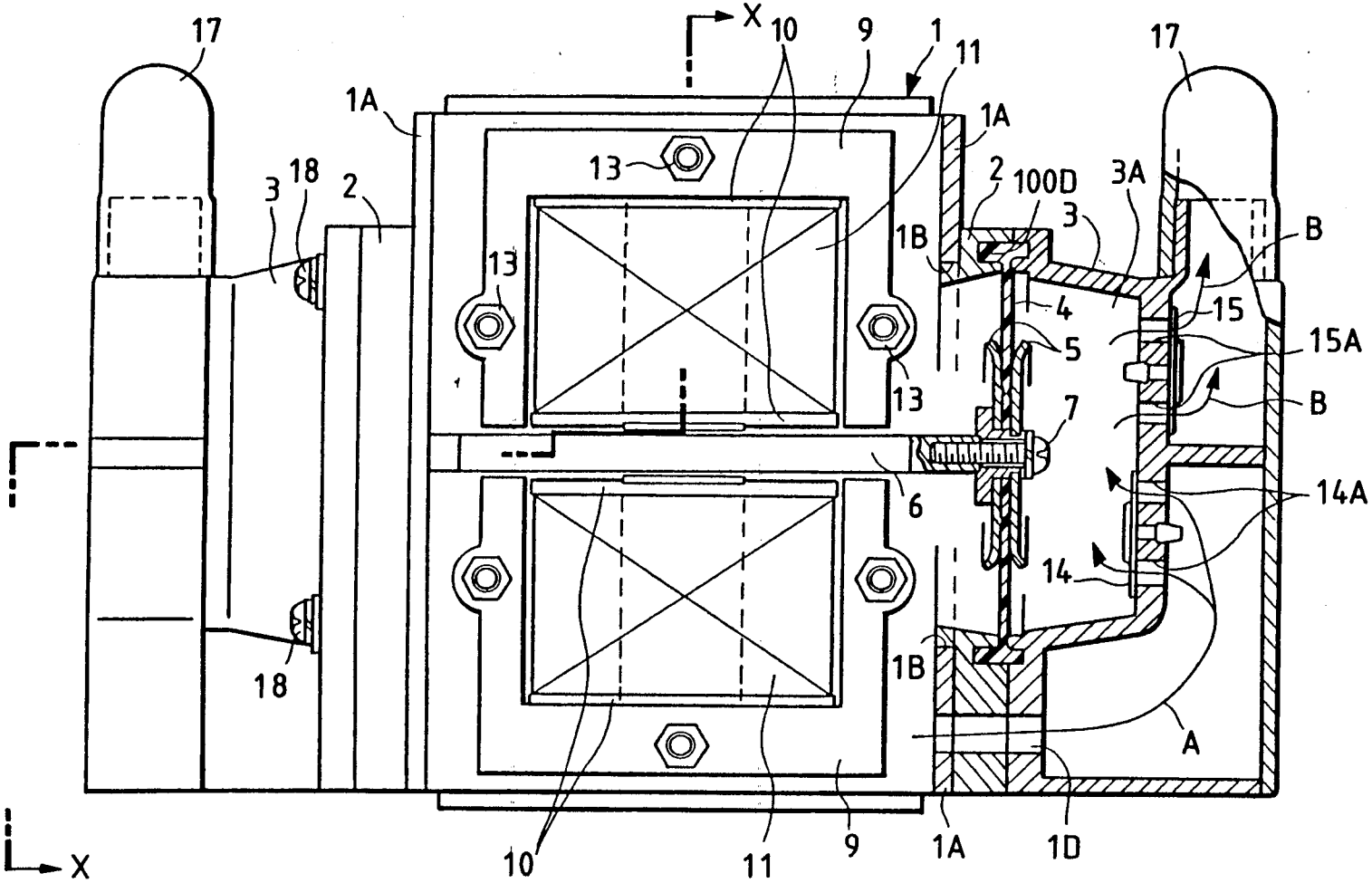
FIG. 15 PRIOR ART
FIG. 15 is a partially cross-sectional plan view of FIG. 14.
Figure 16:
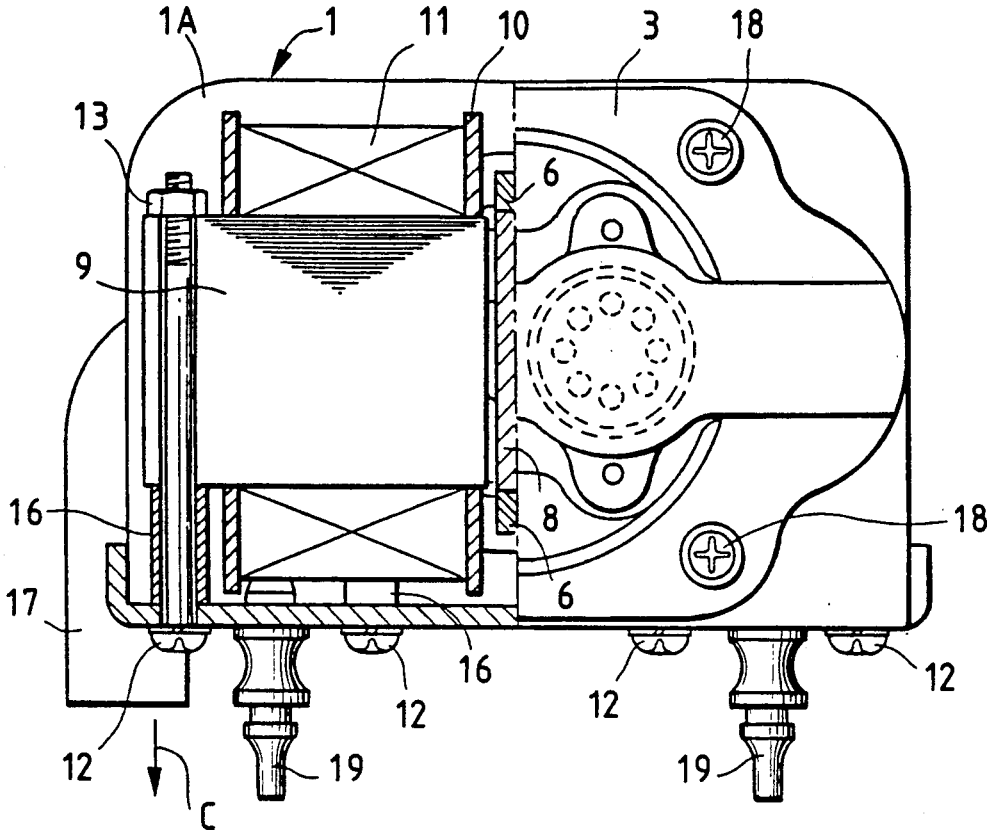
FIG. 16 PRIOR ART
FIG. 16 is a partial cross-sectional view along the X—X line of FIG. 15.
Figure 17:
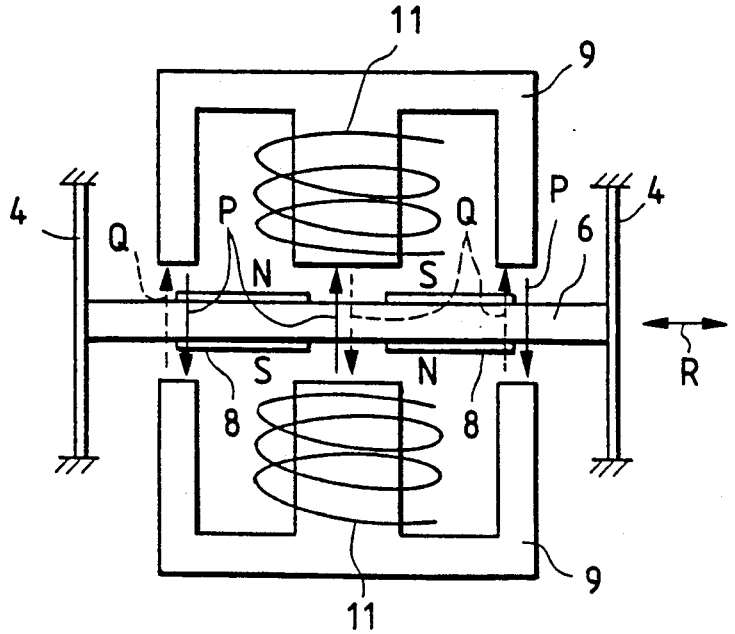
FIG. 17 is a schematic illustration showing the operation principle of the electromagnetic diaphragm pump.

Now, the present invention is described in detail with reference to the drawings. FIGS. 1-3 are illustrations similar to FIGS. 14-16, and in these figures, the symbols same as in FIG. 14-16, represent the same or identical portions, so the explanation therefor is omitted.

In FIGS. 1-3, a magnet holder 160 and a pair of magnets 8 constitute the vibrator of the electromagnetic diaphragm pump. A housing 100 is a resin molding or a cast ariticle of a metal such as aluminium. In the bottom of the housing 100, mounts 100A and 100B are integrally formed for positioning and fixing a pair of field cores 9. Through the mounts 100A and 100B, internal threads 100C are buried as shown in FIG. 3. Of course, if the housing 100 is made of a material such as a metal which has a sufficient mechanical strength, alternative screw holes may be formed through the mounts 100A and 100B.

Also, fitting portions or recess 100D are formed in the housing 100 for fitting the diaphragms 4. That is, a part corresponding to the conventional diaphragm plate 2 as shown in FIGS. 14 and 15 is integrally formed with the housing 100. Reinformcement such as ribs may be provided to the housing 100 as necessary to increase the mechanical strength thereof, though they are not shown.

On the mounts 100A and 100B of the housing 100 thus constructed, the field cores 9 having a coil attached thereto respectively are mounted and positioned. And, bolts 120 are screwed into the internal threads (screw holes) 100C formed through the mounts 100A and 100B, thereby fixing the field cores 9 to the mounts 100A and 100B.

If the housing 100 is molded of resin or the like, it is recommended that for the pair of field cores 9 opposing each other are fixed by the bolts 120 and reinforcing members 200. In order that the reinforcing members 200 are not brought in contact with the magnet holder 160, sleeves 200A are placed between the reinforcing members 200 and the field cores 9. By providing the reinforcing members 200, there will be no possibility that the housing may bend or the field cores 9 may approach to each other even if a strong magnetic force acts between the opposed field cores 9.

Instead of the reinforcing members 200, alternate reinforcing members (not shown) may naturally be fixed by screwing or the like between a pair of side plates 100V which are orthogonal with the side plates 100U having fitting portions 100D therein and the bottom plate of the housing 100.

The magnet holder 160 has two clicks 160A on the upper edge surface thereof which are spaced apart by a predetermined distance. A projecting portion 10B is formed in the center of the upper edge of the portion of one bobbin 10A of the two bobbins having the coils 11 wound which is opposed to the other bobbin 10, and a power switch 210 is attached to the projecting portion 10B by a screw 220. 10C is a groove for leading out a lead wire which is not shown.

When the power switch 210 is ON, the pair of coils 11 is energized and the magnet holder 160 reciprocates with a predetermined frequency. This causes the diaphragms 4 to reciprocate whereby the fluid is discharged as shown by an arrow C. If there have been no breakage or the like in the diaphragms 4, the center of vibration of each click 160A is in the position shown in FIGS. 1 and 2 and the amplitude is within a small predefined range, so that the clicks 160A do not collide with a working end 212B of a lever 212 even when the clicks 160A vibrate.

If a crack or other damage occurs in at least one diaphragm 4, the vibration of the magnet holder 160 may be biased toward one diaphragm 4 to shift the center of vibration of each click 160A or the amplitude of the vibration may become greater, whereby at least one click 160A abuts on the working end 212B. As a result, the lever 212 swings about its supporting shaft and the electrical contacts of the switch 210 are open whereby the coils 11 are deenergized.

After renewing of the diaphragm 4, when the lever 212 is restored to the normal position to bring the electrical contact in contact again, the electromagnetic diaphragm pump is enabled to operate.

Now, the construction of the housing 100 is described in detail with reference to FIGS. 4-6. In these figures, the symbols same as FIGS. 1-3 represent the same or identical portions.

In the housing 100, as previously described, the mounts 100A and 100B and the fitting portions 100D are formed. In the mounts 100A and 100B, the screw holes 100C are formed, respectively. In each of the mount 100A, stepwise portion 100F is formed for positioning the field core 9.

Figure 7:
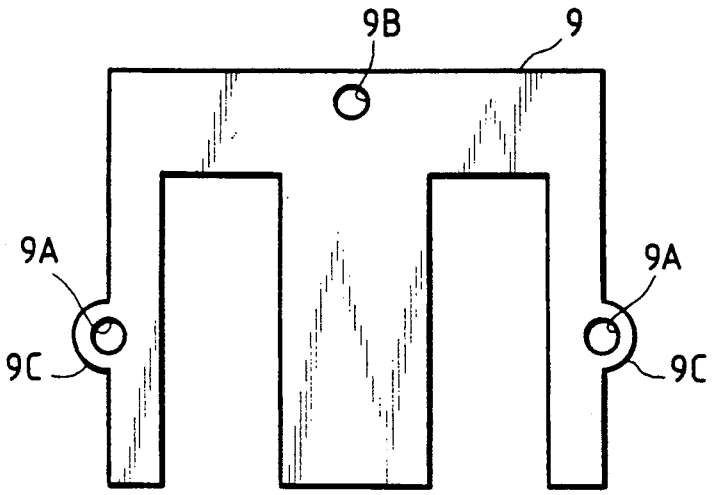
FIG. 7 is a plan view of the field core 9.

The E-shaped field cores 9 are provided with, as shown in FIG. 7, mounting holes 9A in a pair of end legs and a mounting hole 9B in a center portion thereof. A projecting or ear portion 9C is formed in each leg section so that each mounting hole 9A can be offset from the central portion of each leg section for preventing the magnet reluctance of the field cores 9 from increasing.

Returning to FIGS. 4–6, in each of the mount 100A, the stepwise portion 100F having substantially the same shape as the contour shape of the projecting or ear portion 9C is formed for fitting with the projecting portion 9C of the field core 9 and holding it thereby to position the field core 9 with respect to the housing 100. When the field cores 9 are mounted on the mounts 100A and 100B so that the projecting portions 9C of the field cores 9 fit with the corresponding stepwise portions 100F, the field cores 9 are accurately positioned. After this, when the screws 120 are screwed in the screw holes 100C, the field cores 9 are fixed at the predetermined positions in the housing 100.

Figure 4:
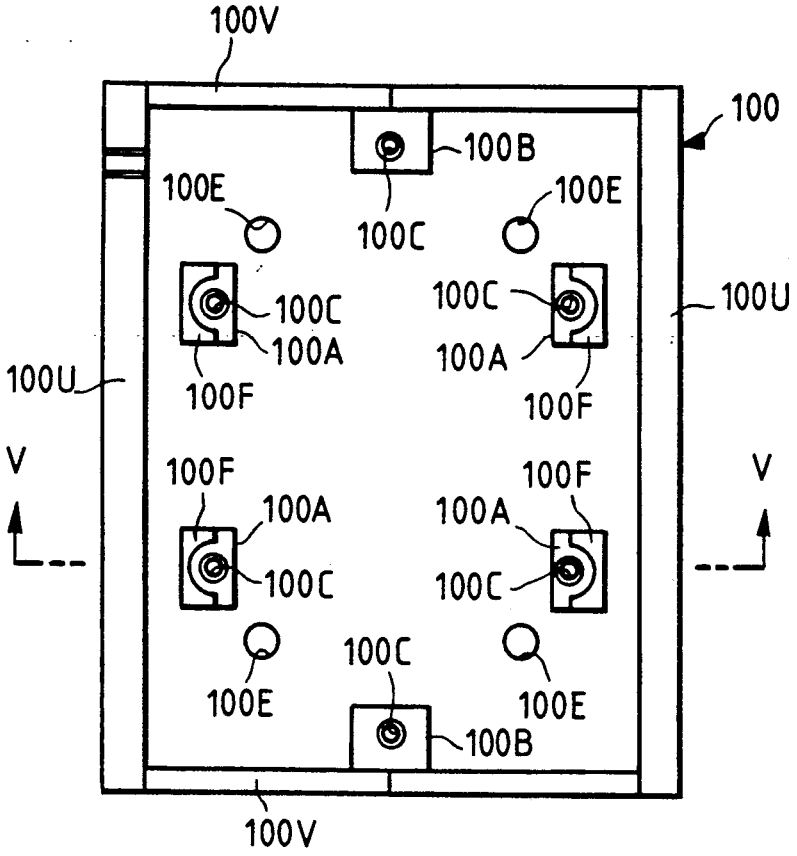
FIG. 4 is a plan view of the housing 100.
Figure 5:
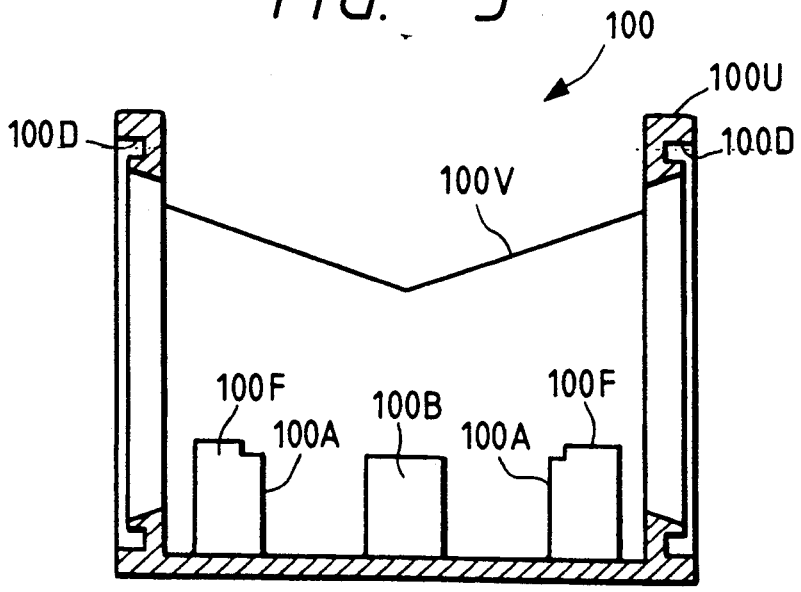
FIG. 5 is a cross-sectional view along the V—V line of FIG. 4.
Figure 6:
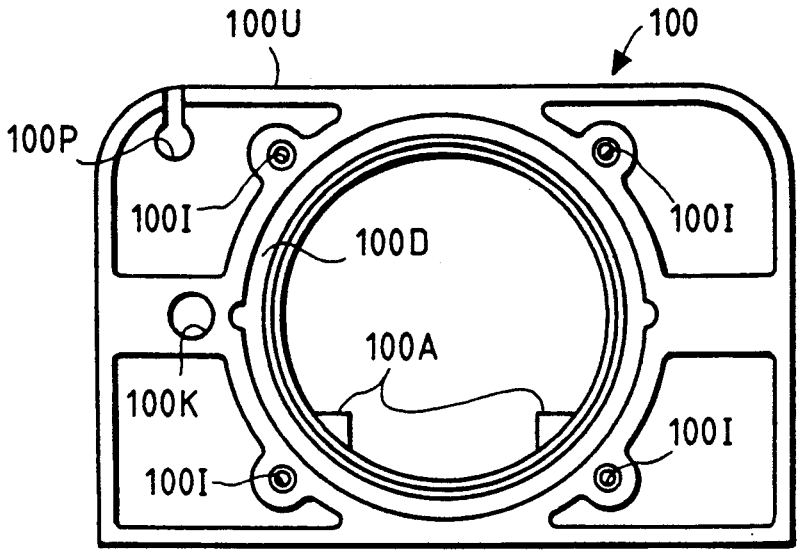
FIG. 6 is a right side view of FIG. 4.

Plural 100E of FIG. 4 represent the mounting holes for mounting the rubber vibration insulators 19 (FIGS. 1 and 3). 100I of FIG. 6 represents the screw holes for attaching the head cover 3 (FIGS. 1–3) to the housing 100, or the screw holes for the screws 18 (FIG. 1), 100K represents the vent hole for taking the fluid into the diaphragm chamber 3A (FIG. 2), and 100P represents the lead hole for the lead wires from the coils 11 and the power lead wires. The screw holes 100I may be buried or directly worked in the housing 100.

Since, in this invention, the housing 100 is a molding of a resin or a cast article of a metal and the mounts 100A and 100B on which the field cores 9 are to be mounted are integrally formed with the housing, its assembling is easier as compared with the conventional electromagnetic diaphragm pump wherein a sleeve is needed to be placed between the housing and the field cores 9. Also, it is possible to accurately set the dimension of each portion of the housing 100, the distance between the diaphragms, for instance, can accurately be set and the efficiency of the electromagnetic diaphragm pump can be increased to the greatest extent.

Since, in the present embodiment, the stepwise portions 100F are formed in the mounts 100A for positioning the field cores 9, no jig is required to attach the field cores 9 and its assembling becomes easier. In addition, since there is no possibility of the shift of the mounting position of the field cores 9 when the electromagnetic diaphragm pump is transported or when it is operated, the efficiency of the electromagnetic diaphragm pump never reduces.

Moreover, in the present embodiment, the screw holes 100C are buried or formed through the mounts 100A and 100B, so that the fixing of the field cores 9 can be done only by tightening the screws 120, whereby the assembling of the field cores 9 are further facilitated.

Figure 9:
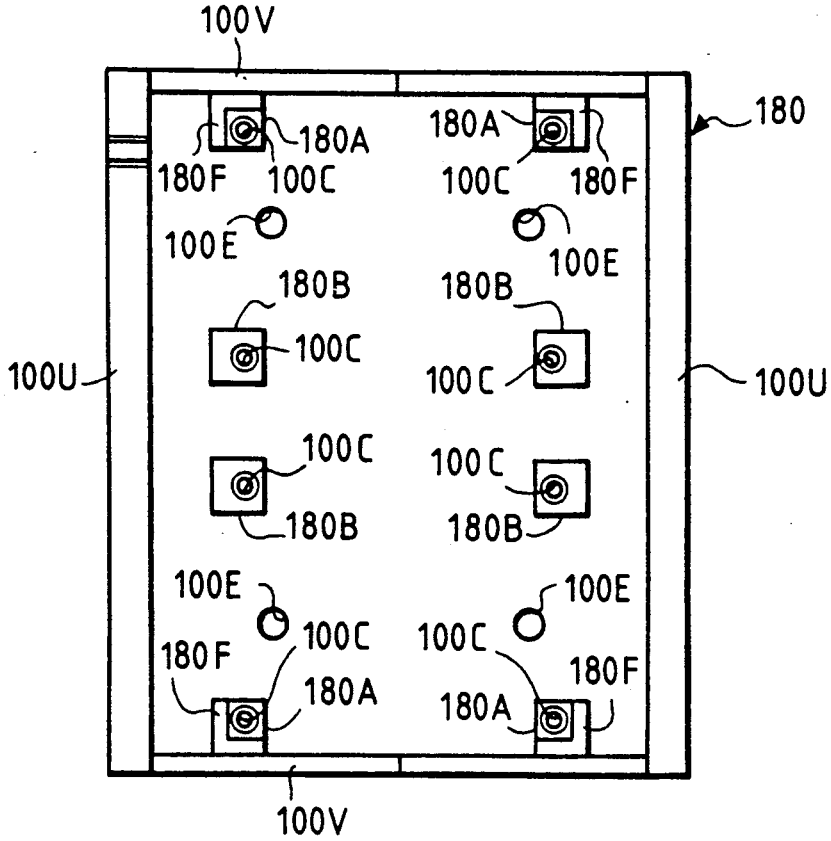
FIG. 9 is a plan view of another example of the housing.
Figure 8:
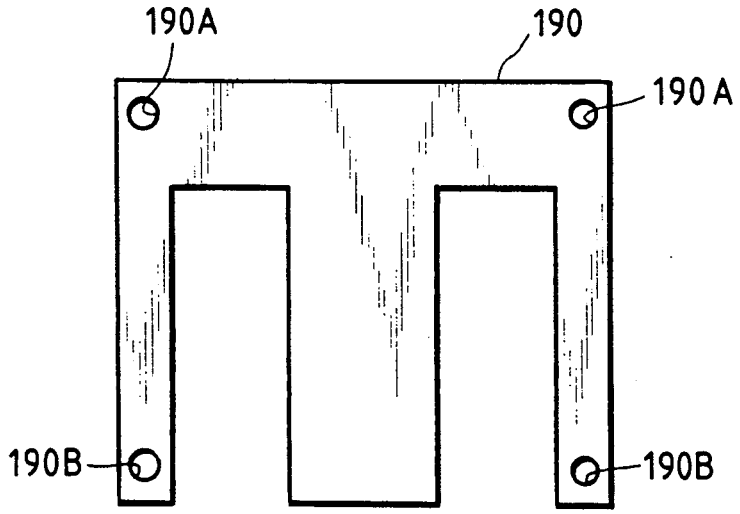
FIG. 8 is a plan view of another example of the field core.
Figure 10:
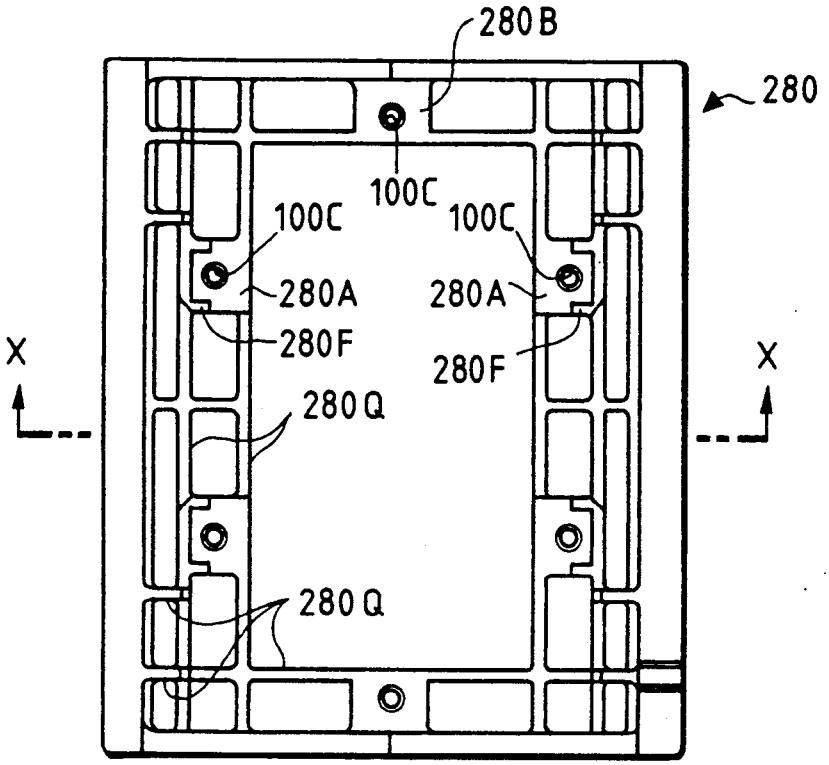
FIG. 10 is a plan view of still another example of the housing.
Figure 11:
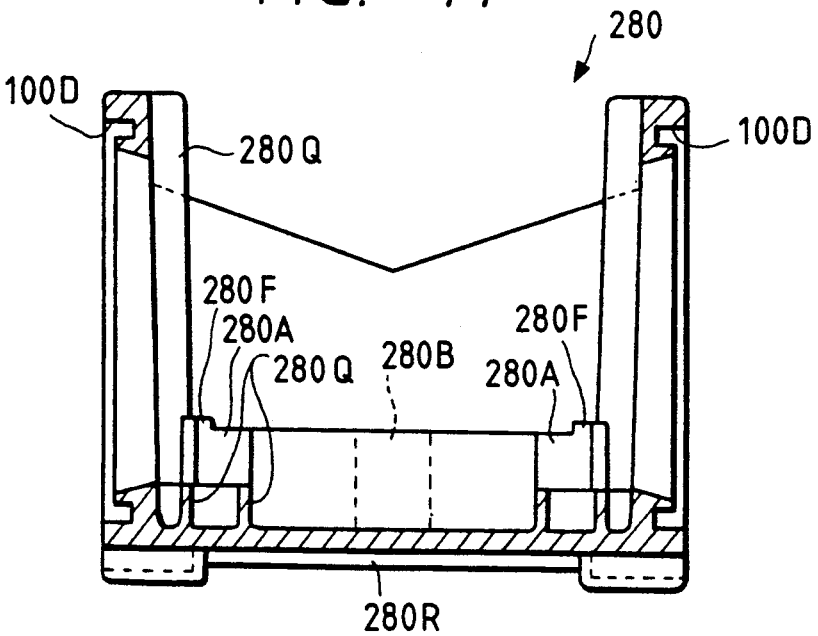
FIG. 11 is a cross-sectional view along the X—X line of FIG. 10.
Figure 12:
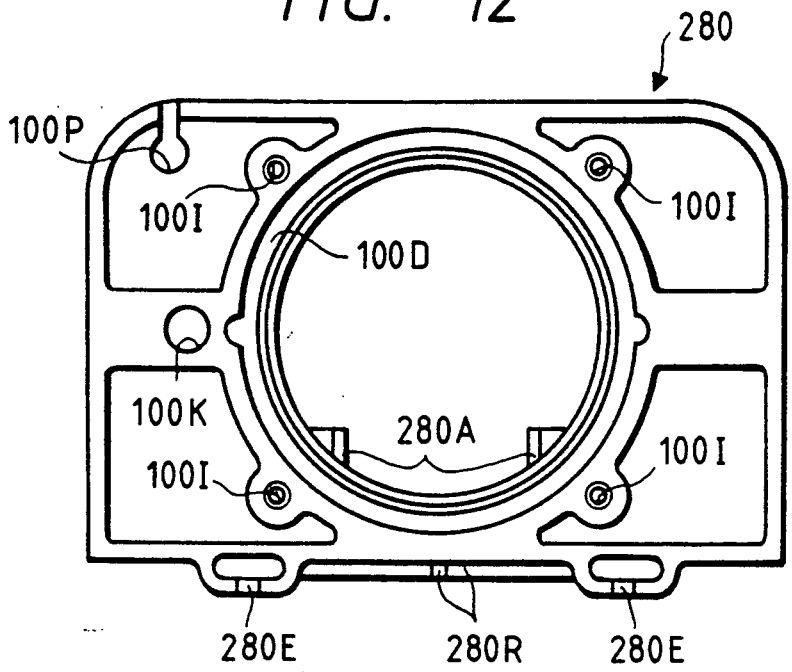
FIG. 12 is a right side view of FIG. 10.
Figure 13:
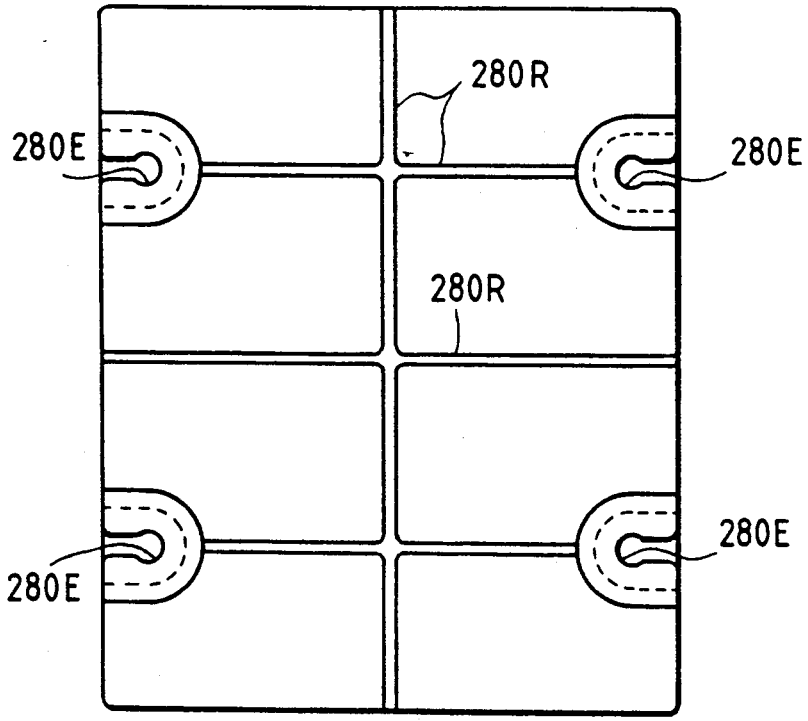
FIG. 13 is a bottom view of FIG. 10.

If the field core 9 is provided with four mounting holes 190A and 190B in the end and base portions of the legs as shown in FIG. 8, but does not have the projecting portions 9C in the middle of the leg portions as shown in FIG. 7, it is recommended that the mounts 180A and 180B are provided on the bottom of a housing 180 corresponding to each mounting hole, as shown in FIG. 9. Here, every symbol 180F represent the stepwise portions for fitting with and supporting the contour portions of the field core 190 in the vicinity of the portions where the mounting holes 190A are bored, thereby positioning the field core 190.

In FIGS. 10–13 showing further example of the housing, a housing 280 is molded with resin. The mounts 280A and 280B and the stepwise portions 280F formed on the bottom plate of the housing 280 show the portions identical to the mount 100A and 100B and the stepwise portions 100F shown in FIGS. 4–6.

In the housing 280, ribs 280Q and 280R are formed on the internal surface and the underface of the bottom for reinforcing. By forming the ribs 280Q and 280R, the housing 280 is hardly bent or deformed by a strong magnetic force produced between a pair of field cores mounted on the housing 280.

280E represents the mounting holes for attaching the rubber vibration insulators 19 shown in FIGS. 1 and 3 to the housing 280.

The shapes and the number of the ribs 280Q and 280R shown in FIGS. 10–13 are for illustration only and should be determined properly according to the material constituting the housing and the size thereof, etc. The setting of the shapes and the number of the ribs can easily be done by those skilled in the art.

As apparent from the above description, the following technical advantages can be accomplished by the present invention.

Since the mounts for positioning and mounting the field cores and the fitting portions for fitting the peripheral portions of the diaphragms therewith are formed integrally with the housing, the positioning of the field cores is performed only by mounting the field cores on the mounts. Accordingly, no jig is required when the field cores are assembled, and the field cores can easily be attached.

It is not needed to place the sleeve, which has so far been required, between the housing and the field cores when the field cores are fixed to the housing. Therefore, the assembling and fixing of the field cores become further easier.

In addition, if the stepwise portions are formed for positioning the field cores on the mount, the field cores abut against the stepwise portions and are positioned, so that the attaching positions of the field cores in the housing do not shift after the field cores are attached. Accordingly, there is no possibility of resulting in reduction of the efficiency of the electromagnetic diaphragm pump or reduction of the durability of the diaphragms due to the losing of the balance of the vibration of the vibrator.

Further, it is easy to increase the dimensional accuracy of the housing, mounts and fitting portions so that the field cores, diaphragms and the like can be arranged with a good precision. Thus, the efficiency of the electromagnetic diaphragm pump can be increased to the greatest extent.

Only by screwing screws into the screw holes formed or buried in the mounts, the field cores can be fixed to the bottom of the housing. Therefore, the attaching and fixing of the field cores become further easier.

Since the housing is molded of resin which is a nonmagnetic material, there will be no leakage magnetic flux which emanates from the field cores and passes through within the housing. Accordingly, the efficiency of the electromagnetic diaphragm pump further increases. Also, the pump is made lightweight. No grommet is required when the housing is passed through with lead wires.

WHAT IS CLAIMED IS:

1. An electromagnetic diaphragm pump comprising a pair of diaphragms placed apart so as to be opposed to each other, a pair of closed diaphragm chambers having an intake valve and a discharge valve, each of which is partially comprised of said diaphragms, a vibrator shaped in a flat board having at least one magnet attached thereto, said vibrator being connected to said each diaphragm at opposite ends thereof and positioned at the middle of said pair of diaphragms, a pair of field core halves, each having a coil wound therearound, said field core halves being placed apart on both sides of the flat boardshaped vibrator so that the respective magnetic poles of the field core halves are opposed to said at least one magnet, a base member housing comprising a bottom plate and substantially parallel side walls which are formed in one piece, said housing having an open top, the bottom plate having protruding mounts thereon for positioning and mounting the pair of field core halves, which mounts are formed in one piece with the bottom plate, and the side walls being provided with fitting portions into which the pair of diaphragms are fitted, respectively, the pair of the closed diaphragm chambers being supported by the side walls outside thereof, the pair of the field core halves being fixed to the bottom plate individually in such a position that main side surfaces of the core halves are substantially parallel to the bottom plate.

2. The electromagnetic diaphragm pump as set forth in claim 1 and screw holes formed in said protruding mounts, said screw holes receiving screws for attaching said field core halves to said protruding mounts.

3. The electromagnetic diaphragm pump as set forth in claim 1 wherein said housing is formed with resin.

4. The electromagnetic diaphragm pump as set forth in claim 1 wherein stepwise portions are formed in an upper part of said protruding mounts for facilitating the positioning of the field core halves.

5. The electromagnetic diaphragm pump as set forth in claim 4 wherein said housing is formed with resin.

* * * * *